United States Patent [19]

Kabaya

[11] Patent Number: 4,916,968

[45] Date of Patent: Apr. 17, 1990

[54] DEVICE FOR MOUNTING AN OPERATING LEVER FOR A GAS SPRING

[75] Inventor: Satoshi Kabaya, Yokosuka, Japan

[73] Assignee: Okamura Corporation, Yokohama, Japan

[21] Appl. No.: 402,791

[22] Filed: Sep. 1, 1989

Related U.S. Application Data

[63] Continuation of Ser. No. 190,342, May 5, 1988, abandoned.

[30] Foreign Application Priority Data

May 15, 1987 [JP] Japan ..... 62-71651

[51] Int. Cl.[4] ..... G05G 1/04; A47C 3/00

[52] U.S. Cl. ..... 74/519; 74/522.5; 403/67; 403/79; 16/257; 16/267; 248/222.2; 248/229; 248/231.8; 297/306; 297/355

[58] Field of Search ..... 74/501, 501.5, 502, 74/503, 504, 469, 473, 519, 522.5; 403/67, 68, 79; 16/254, 257, 259, 260, 261, 267, DIG. 13; 248/222.2, 222.1, 221.2, 220.2, 229, 231.8; 297/306, 355, 353

[56] References Cited

U.S. PATENT DOCUMENTS

| | | | |
|---|---|---|---|
| 2,671,379 | 3/1954 | Eloranta | 88/53 |
| 2,732,581 | 1/1956 | Heck | 16/171 |
| 3,066,367 | 12/1962 | Garman | 24/81 |
| 3,807,796 | 4/1974 | Wirges | 297/355 |
| 3,817,575 | 6/1974 | Bocksch et al. | 297/347 |
| 3,837,704 | 9/1974 | Bauer | 297/355 |
| 3,880,465 | 4/1975 | Scheben | 297/355 |
| 4,227,283 | 10/1980 | Mathewson et al. | 16/128 R |
| 4,471,994 | 9/1984 | Zund | 297/355 |
| 4,549,670 | 10/1985 | Trendler | 220/338 |
| 4,665,585 | 5/1987 | Westin | 16/302 |
| 4,743,065 | 5/1988 | Meiller | 297/306 |
| 4,787,673 | 11/1988 | Locher | 297/355 |

FOREIGN PATENT DOCUMENTS

| | | |
|---|---|---|
| 1306254 | 10/1961 | France . |
| 54-24166 | 2/1979 | Japan . |
| 60-72644 | 5/1985 | Japan . |

*Primary Examiner*—Gary L. Smith
*Assistant Examiner*—F. Saether
*Attorney, Agent, or Firm*—Zarley, McKee, Thomte, Voorhees & Sease

[57] ABSTRACT

A device for mounting an operating lever for operating a gas pressure control plug of a gas spring is disclosed, in which the operating lever is in contact with the free end of the gas pressure control plug supported on a mounting frame of a seat or the like. The operating lever has a short shaft provided at an end and extending perpendicular to the axis of the gas spring. The short shaft is pressure fitted in an engagement groove, which is provided in a synthetic resin bearing block secured to a mounting frame and has a more-than-semicircular arcular sectional profile.

5 Claims, 3 Drawing Sheets

DEVICE FOR MOUNTING AN OPERATING LEVER FOR A GAS SPRING

This application is a continuation of application Ser. No. 190,342, filed May 5, 1988, now abandoned.

BACKGROUND OF THE INVENTION

1. Field of the Invention

This invention relates to improvements in a device for mounting an operating lever for a gas pressure control plug for a gas spring for controlling the inclination of a chair seat, height of a table top plate, etc.

2. Prior Art

FIG. 5 shows a prior art device for mounting an operating lever of the type noted above. As is shown, a mounting frame 2A which supports a gas spring 1 has a pair of support plates 3A facing each other. An operating lever 4A which has one end in contact with a free end 12A of a gas pressure control plug 11 is pivotally mounted by a pn 41A between the support plates 3A. The pin 41 is retained by caulking each of its ends on the outer side of each support plate 3A or fitting a retainer ring in an annular groove formed in each end portion of the pin 41A.

In the prior art, however, the operation of mounting the operating lever 4A is cumbersome. If the operating lever 4A itself is formed with a hole 42A for its pivotal mounting, its mechanical strength is reduced so that it is liable to be readily broken.

To overcome such drawback, there has been provided a device as shown in FIGS. 6 and 7, in which a short shaft 43B is secured to a stem portion of operating lever 4B such that it extends perpendicular thereto, a mounting plate 2B is provided with pair projecting supports 21B and through holes 22B formed on the outer sides of the projecting supports 21B, a substantially U-shaped leaf spring 5B has its opposite legs inserted through the through holes 22B, and opposite ends of the short shaft 43B are fitted in through holes 52B formed in end portions of the legs 51B of the U-shaped leaf spring 5B by utilizing the elasticity thereof (FIG. 7). (See Japanese Utility Model Laid-Open Publication No. 60-72644).

In the device as described as above, the mounting frame 2B has to be provided with the projecting supports 21B and formed on the outer sides thereof with the through holes 22B, and also the substantially U-shaped leaf spring 5B has to be prepared. Therefore, the structure is complicated. Besides, the short shaft 43B is subjected to friction with the edge of the through holes 52B in the leafspring 5B to produce uncomfortable sound at the time of operation.

OBJECT OF THE INVENTION

In order to solve the above problems in the prior art, the invention has an object of providing a device, which has a simple structure and capable of being operated smoothly.

SUMMARY OF THE INVENTION

According to the invention, there is provided a device for mounting the operating lever for a gas spring, in which the operating lever is in contact with the free end of a gas pressure control plug of a gas spring supported on a mounting frame of a seat or the like, and which comprises a short shaft provided at an end of the operating lever and extending perpendicular to the axis of the gas spring, and a synthetic resin bearing block secured to a mounting frame and having an engagement groove having a more-than-semicircular arcular sectional profile, the short shaft being pressure fitted in the engagement groove such that it will not be readily detached therefrom.

When the short shaft of the operating lever is forcibly fitted in the engagement groove against the elasticity of opposite embracing arms of the engagement groove, it is held in forced contact with the embracing arms, so that it can be turned without generation of any uncomfortable noise in the engagement groove of the synthetic resin bearing block at the time of operation of the device.

DETAILED DESCRIPTION OF THE PREFERRED EMBODIMENT

Now, an embodiment of the invention will be described in detail with reference to the drawings.

Figure 1:
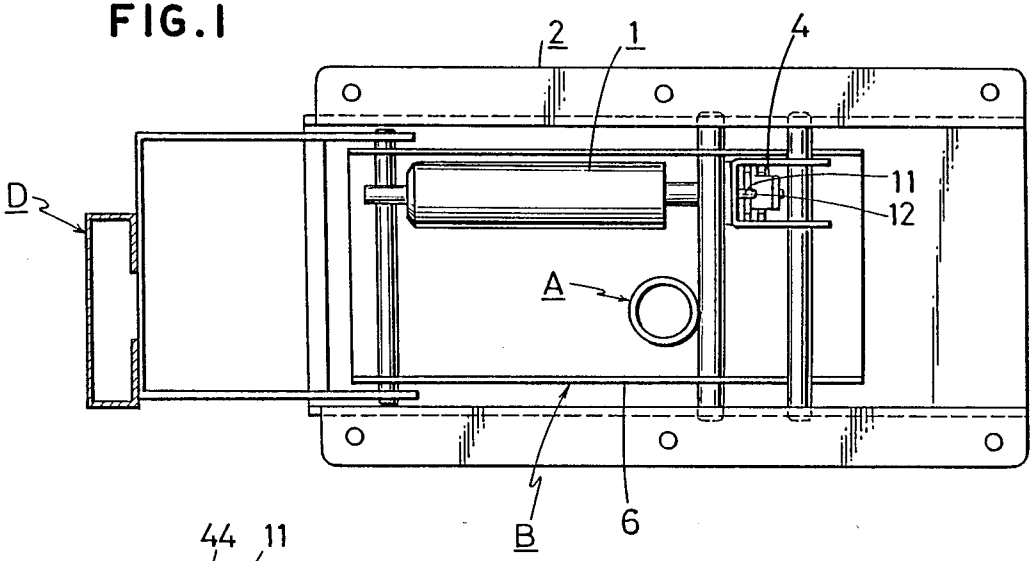
FIG. 1 is a plan view showing an essential portion of a chair according to the invention with a seat plate removed.
Figure 2:
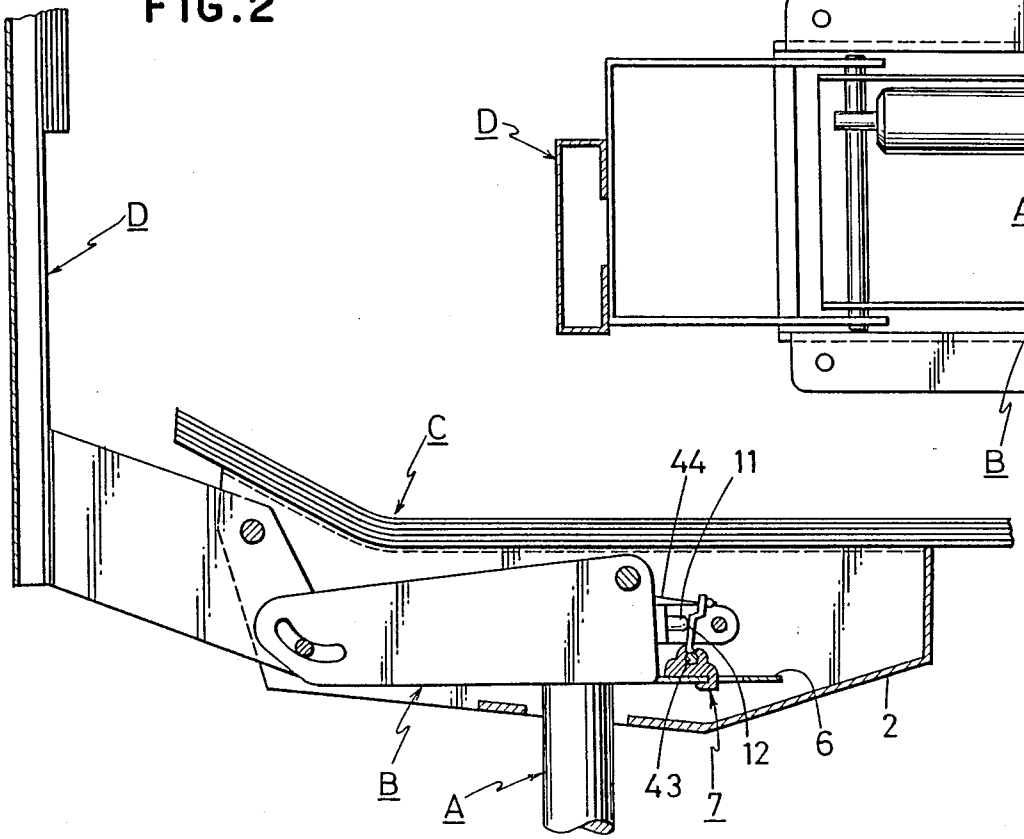
FIG. 2 is a back-and-forth central sectional view showing the same chair.

FIGS. 1 and 2 illustrate an essential part of a chair according to the invention, with a seat plate removed.

Referring to FIGS. 1 and 2, designated at A is a vertical support, designated at B is a base secured to the top of the support A, designated at C is a seat with a mounting frame 2 capable of inclination angle control, and designated at D is a back support provided at the rearward portion of the base B and capable of inclination angle control.

A gas spring 1 is supported on the mounting frame 2 of the seat C, and an intermediate portion of the operating lever 4 is in contact with the free end 12 of a gas pressure control plug of the gas spring 1.

Figure 3:
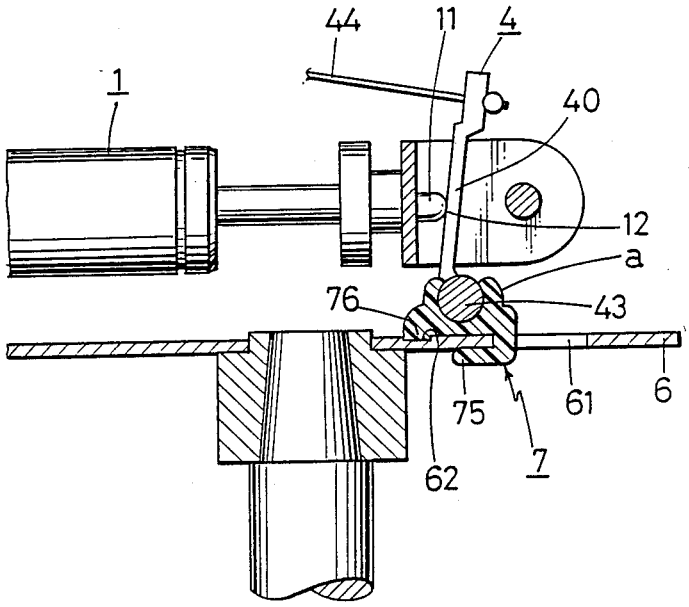
FIG. 3 is an enlarged-scale sectional view showing an essential portion of the same chair.
Figure 4:
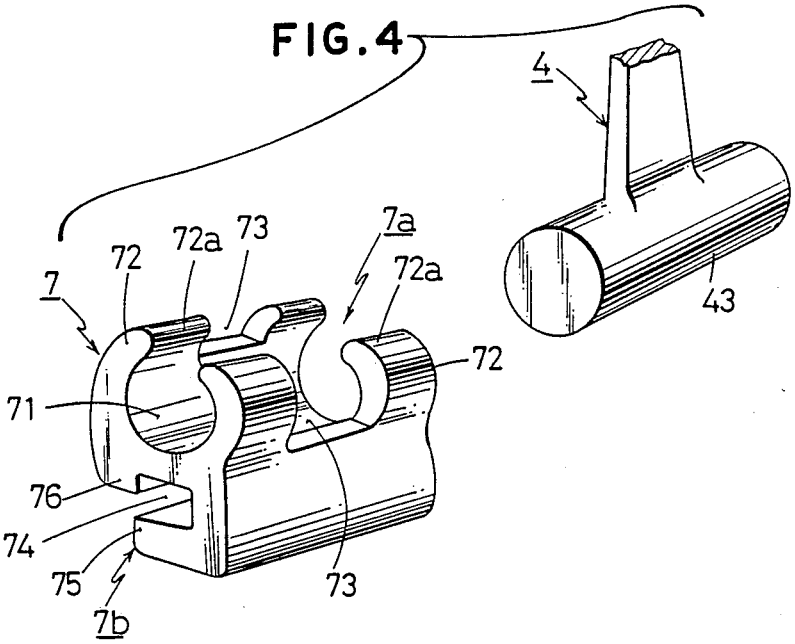
FIG. 4 is an exploded perspective view showing the same portion.
Figure 5:
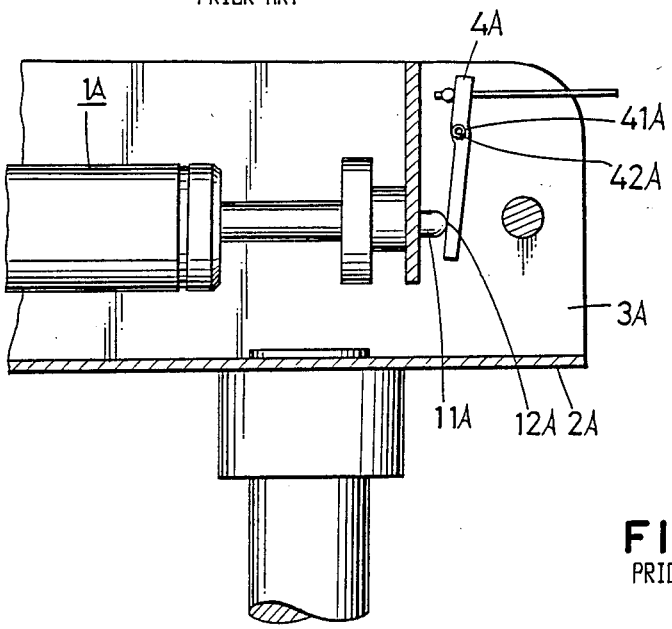
FIG.5 PRIOR ART
FIG. 5 is a fragmentary sectional view showing an essential portion of a prior art chair.
Figure 6:
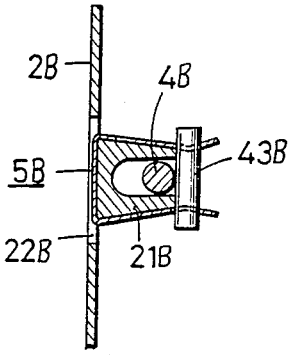
FIG.6 PRIOR ART
FIG. 6 is a sectional view showing an essential portion of a prior art improved chair.
Figure 7:
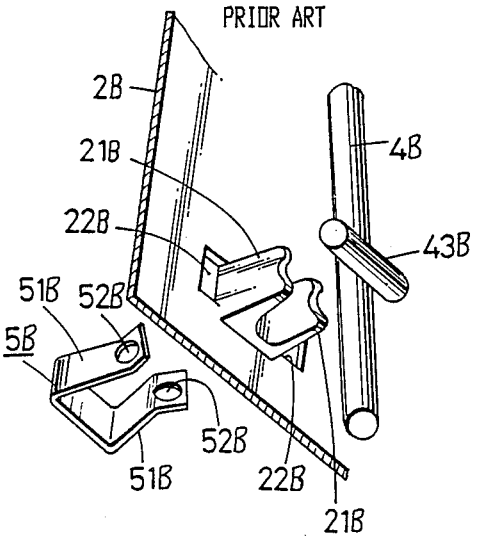
FIG.7 PRIOR ART
FIG. 7 is an exploded perspective view showing the portion shown in FIG. 6.

The operating lever 4, as shown in FIGS. 3 and 4, has a perpendicular short shaft 43 provided at the lower end. Its upper end can be pulled backwards by a wire 44. It can be rocked back and forth about the short shaft 43.

The short shaft 43, as shown in FIG. 3, is rockably mounted in a bearing block 7 which is fittedly secured to a base frame 6 of the base B.

The bearing block 7 consists of a synthetic resin. As shown in FIG. 4, it has a lower engagement portion *7b* for engagement with the base frame and an upper engagement portion *7a* for engagement with the short shaft.

The upper engagement portion *7a* has a transversal engagement groove 71 and semi-arcular embracing portions 72 facing each other such as to form respective front and rear walls of the engagement groove 71. Each embracing portion 72 has a notch 73 formed in a central portion of its free edge. The notch 73 may be provided in only one of the front and rear embracing portions 72.

The engagement groove 71 has a more-than-semicircular arcular sectional profile and has substantially the same diameter as the outer diameter of the short shaft 43.

To assemble the operating lever 4 in the bearing block 7, the short shaft 43 is set between the edges 72*a* of the front and rear embracing portions 72 of the bearing block 7 and then pushed down. As a result, the edges 72*a* of the embracing portions 72 are forced apart from each other so that the short shaft 43 is pressure fitted in the engagement groove 71 defined by the embracing portions 72.

The lower engagement portion 7*b* of the bearing block 7, as shown in FIG. 4, has a groove 74 open sidewise, and its portion 75 constituting the lower wall of the groove 74 covers substantially one half of the width of the bearing block 7. The front edge of the upper wall of the groove 74 has a ridge 76 which is adapted to wedge into the top surface of the base frame 6. The groove 74 has a vertical dimension which is substantially the same as the thickness of the base frame 6 (FIG. 3).

In FIG. 3, the base frame 6 has a through hole 61 and a groove 62.

To assemble the bearing block 7 on the base frame 6, its portion 75 is moved through the through hole 61 and then lowered forwards with the open front of the groove 74 in register with the edge of the through hole 61. As the bearing block 7 is thus advanced, the portion 75 comes to engage the base frame 6 and is outwardly flexed. Eventually, the ridge 76 is received in the groove 62, whereby the portion 75 is forcedly engaged with the lower surface of the base frame 6.

It is possible to assemble together the bearing block 7 and base frame 6 first and then assemble the operating lever 4 in the bearing block 7.

When all the assembly operations are completed, the free end 12 of the gas pressure control plug 11 is in contact with an intermediate portion of the operating lever 4, as shown in FIG. 3, and the upper end of the operating lever 4 can be pulled by the wire 44.

According to the invention, the embracing portion of the bearing block can be forced apart by a synthetic resin tool and, in this state, the operating lever can be assembled such that its short shaft is rotatably fitted in the more-than-semicircular arcular engagement groove and in the central notches in the embracing portions to be held against sidewise displacement.

In the operation of the device, the operating lever can be rotated smoothly without generation of any uncomfortable sound.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A device for mounting an operating lever for a gas spring, in which said operating lever is in contact with the free end of a gas pressure control plug of the gas spring while supported on a mounting frame of a seat or the like, which comprises:

a short shaft provided at an end of said operating lever and extending perpendicular to the axis of said gas spring;

an elongated synthetic resin bearing block secured to a mounting frame;

the bearing block having opposite front and rear walls with a semi-arcuate engagement groove extending longitudinally between the front and rear walls;

the bearing block also having a mounting portion with a longitudinally extending mounting groove below said engagement groove which opens towards one of said bearing block walls for receiving a portion of said mounting frame; and said short shaft being press fitted in said engagement groove such that it will not be readily detached therefrom.

2. The device according to claim 1, wherein a central portion of at least one of the edges of the opening of said engagement groove of said bearing block is formed with a notch, said operating lever being received in said notch when said operating lever is rocked.

3. The device of claim 1 wherein the mounting portion of the bearing block includes a tongue portion which defines a portion of the mounting groove and which extends below said monting plate to mount said bearing block to the mounting plate.

4. The device of claim 3 wherein the tongue portion extends substantially one half the distance between the front and rear walls of the bearing block.

5. The device of claim 3 wherein the mounting portion further includes a ridge adapted to overlappingly engage a portion of said mounting plate.

* * * * *